United States Patent [19]

Knight

[11] 4,292,627

[45] Sep. 29, 1981

[54] TRAFFIC MARKER

[76] Inventor: Val F. Knight, 5900 W. Tropicana Ave., #45, Las Vegas, Nev. 89103

[21] Appl. No.: 72,127

[22] Filed: Sep. 4, 1979

[51] Int. Cl.[3] ..... E01F 9/00; H01H 35/02

[52] U.S. Cl. ..... 340/114 R; 340/114 B; 116/63 C; 40/612; 200/61.52; 200/61.83; 362/394; 362/802

[58] Field of Search ..... 340/114 R, 114 B, 84, 340/87, 122, 686, 687, 666; 116/63 R, 63 P, 63 C, 63 T; 40/612, 598, 903; 200/61.45R, 61.49, 61.52, 61.83, 85 R, 85 A, DIG. 18, 30, 2; 404/6, 9, 12, 13, 14; 250/200, 201; 362/802, 803, 394, 186

[56] References Cited

U.S. PATENT DOCUMENTS 2,905,863 9/1959 Martin et al. ..... 340/114

2,972,739 2/1961 Opper ..... 200/61.52

3,414,858 12/1968 Huffman et al. ..... 200/61.52

3,660,817 5/1972 Abrams ..... 340/114

FOREIGN PATENT DOCUMENTS 1062624 3/1967 United Kingdom ..... 340/114 R

*Primary Examiner*—John W. Caldwell, Sr.
*Assistant Examiner*—Donnie L. Crosland
*Attorney, Agent, or Firm*—Seiler & Quirk

[57] ABSTRACT

A traffic road marker has an upright translucent shell supported on a weighted base. The shell contains a battery and light bulb operated by a self-actuating switch which engages when the shell is placed in an upright position. Optionally connected in the circuit are a circuit interrupter to flash the light bulb and a photocell to shut the circuit off during daylight hours.

2 Claims, 4 Drawing Figures

TRAFFIC MARKER

BACKGROUND OF THE INVENTION

Road safety markers which are used for the purpose of diverting traffic around danger areas, defining vehicular lanes, or indicating the presence of temporary hazards such as roadwork or disabled vehicles, are well known. Typical of present marker devices are the lightweight translucent traffic cones which may contain electric illumination, warning lamps which burn a heavy fuel such as kerosene, and chemical flares which emit a highly visible flame. Chemical flares are more useful for temporary hazards, such as vehicular breakdowns, but have the disadvantage of being non-reusable and of having a very short life. These flares are also quite expensive, and leave a residue which must be cleaned up after usage. Fuel burning lamps are showing diminishing usage because of the expense of the fuel, the potential fire hazard associated with its use, and the necessity to frequently replenish the fuel supply. For most uses, traffic cones, either lighted or unlighted, have become increasingly prominent.

Most traffic cones are fabricated from brightly colored material, such as yellow, orange, or red, and are made from a pliable, resilient plastic which is resistant to accidental impact. Many of these devices are shaped like inverted cones, and are base-weighted to prevent accidental overturning in the event of a strong wind or accidental impact with a vehicle. Many examples of lighted traffic guideposts are found in the prior art. For example, Abrams, U.S. Pat. No. 3,380,428, describes an upright flexible post member which engages a flat hollow base adapted to hold water for weight stabilizing. The Abrams device optionally contains a light bulb imbedded in the post electrically connected to a battery in the base member. A very similar marker is shown in Hegesbach, U.S. Pat. No. 3,795,220, which discloses a cone marker supported on a base consisting of a bag which is filled with liquid ballast. The liquid-filled bag conforms to the contour of any surface on which the marker is placed, and is resistant to damage from being run over by a vehicle wheel. The Hengesbach device also provides for illumination through a small battery-operated electric bulb.

Two other battery-operated illuminated road safety markers are shown in Vara, U.S. Pat. No. 3,732,842, and Whitehead, U.S. Pat. No. 3,696,237. The Vara marker consists of an inverted cone having a stabilizing base with circumferentially oriented legs formed from flexible coil springs. The legs serve to return the marker to an upright position after the marker is tipped. FIG. 5 of the Vara disclosure shows a flashing light accessory carried within the cone. The Whitehead disclosure shows a series of illuminated road marking cones which are electrically connected to each other and to a large storage battery. A sawhorse-type road barricade having a photocell-actuated flasher is shown in Nunn, U.S. Pat. No. 3,506,959.

In modern usage, road markers must often be set in place and removed as rapidly as possible. For example, when rush hour traffic is rerouted, or when traffic is controlled in specific lanes around an athletic stadium, traffic controllers must place the markers as quickly as possible; the markers are frequently set into place by one or more workers standing on the back of a moving truck. Accordingly, it is desirable to minimize the number of activities which a worker must do to establish the unit in place. In addition, it is desirable to have the light bulbs in the cones burning only when necessary, thereby preserving and extending the life of the battery. While it is known to have flashlights and lamps which will extinguish automatically when placed on a support base, as for example those described in Floraday, U.S. Pat. No. 1,937,111, and in Ferris et al, U.S. Pat. No. 1,916,472, no disclosure of a self-actuating illuminated cone is known to applicant.

Accordingly, it is an object of the invention to provide an illuminated traffic cone which automatically lights when the cone is placed in operating position, and shuts off when it is removed from the operating position. It is a further object of the invention to provide a traffic cone which illuminates when ambient lighting conditions decrease to a predetermined level. These and other objects of the invention will be apparent from the detailed description of the invention contained herein.

SUMMARY OF THE INVENTION

A safety marker comprises an upright translucent marker portion, a ground-supported base for stabilizing said marker portion, battery means contained within the marker, electric light means, switch means for automatically actuating the light means when the marker is in an upright position, and electrical circuit means for operatively connecting the battery means, electric light means, and switch means.

BRIEF DESCRIPTION OF THE DRAWINGS

The invention is best understood with reference to the drawings in which.

DETAILED DESCRIPTION OF THE INVENTION

Figure 1:
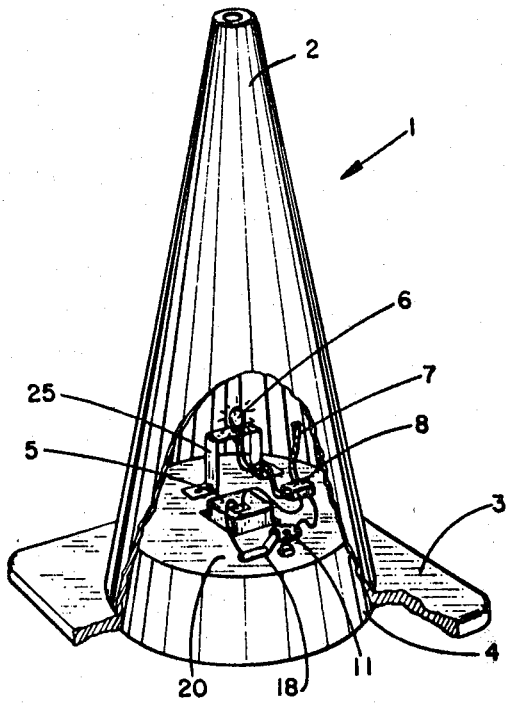
FIG. 1 is a perspective view of a marker of the invention, with a partial section showing the electrical circuitry therein.

Referring to FIG. 1, safety marker 1 has an upper translucent marker portion 2 integral with ground-supported base portion 3. The marker portion consists of an inverted cone shaped member having two fused layers (not shown). The outer layer is polyvinyl chloride impregnated with a bright fluorescent red/orange pigment, and the inner layer is a generally opaque white polyvinyl chloride. The outer fluorescent layer has a thickness of approximately 0.025". The base 3 of the cone is fused into the marker portion, obviating external fastening devices. The base is weighted to provide a low center of gravity for maximum stability of the marker. These cones are commercially available in sizes from about 12" to about 36"; typical commercially available examples are manufactured by A & B Reflectorizing Company of Ontario, California.

A plastic mounting stand 4 having a frustoconical shape is friction fitted into the aperture at the base of the cone. The mounting stand carriers battery 5, light 6, photoelectric cell 7, solar switch 8 with flasher, and the plunger switch mechanisms.

Figure 2:
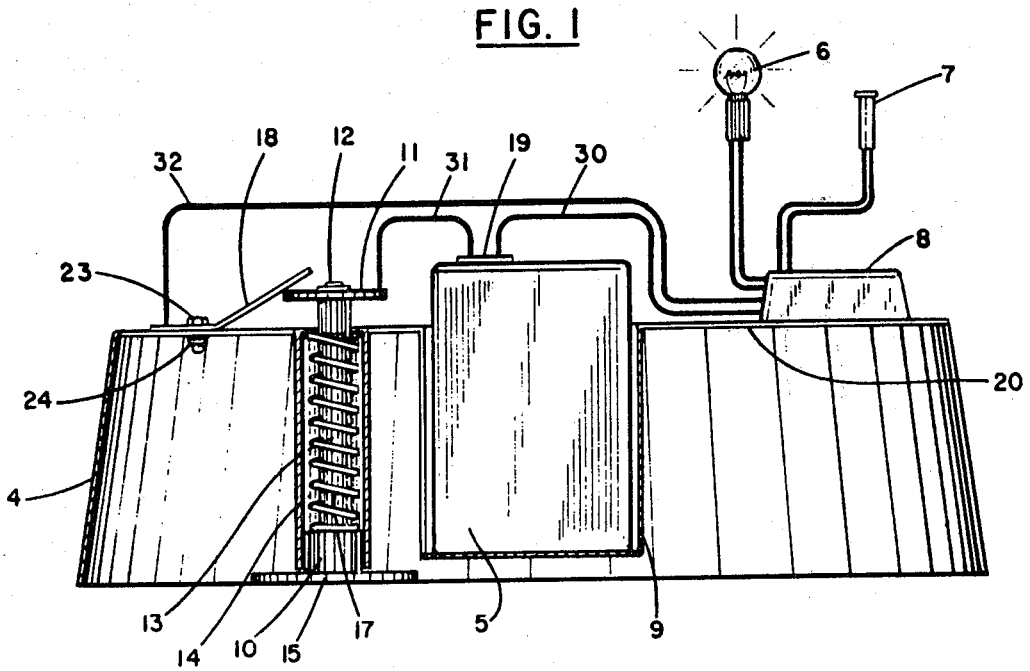
FIG. 2 is a partially schematic side section view of the base portion of the marker.

The electrical circuit is actuated by a spring-operated plunger switch 10 which closes the circuit when the safety marker is in its vertical operating position. The plunger switch consists of a contact disc 11 mounted with spring 12 at the upper end of shaft 13, which extends vertically through bore 14 in mounting platform 4. A ground contacting base 15 is threadedly secured to the lower portion of the shaft. Compression spring 17 coaxially mounted around the shaft 13 maintains the switch in a normally open position. When the safety marker is lying on its side, the base 15 of the plunger switch is forced into a position beyond the bottom of the safety marker, thereby drawing disc 12 away from spring metal contact strip 18, opening the circuit. When the safety member is returned to the vertical position, the weight of the marker compresses the spring and forces the switch into the closed position illustrated in FIG. 2.

The battery 5 is a conventional 6 volt lantern drycell, and is mounted in well 9 of the mounting platform. The battery is equipped with a female double plug terminal (not shown), which interconnects with male double plug 19. The solar switch, lamp, photocell, and plunger switch are mounted on the floor 20 of mounting platform 4. Spring metal contact strip 18 is secured to the floor by means of bolt 23 and nut 24. Photocell 7 and lamp 6 may be separately mounted, for example on mounting bracket 25 shown in FIG. 1, or may be simply secured to the mounting platform with tape or allowed to remain loose on the top of the mounting platform.

Figure 3:
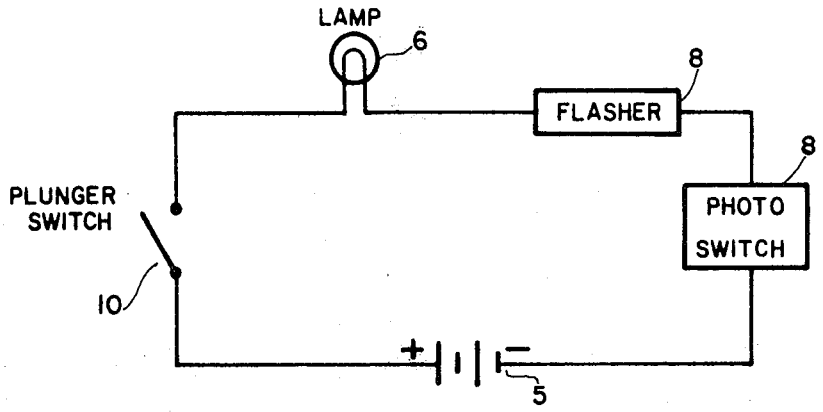
FIG. 3 is a simple block circuit diagram of the electrical circuit used in the marker.

A simplified schematic view of the circuitry is shown in FIG. 3. The photocell switch closes, allowing current to flow, at low ambient light levels. When the plunger switch is closed, current flows from the battery through the flasher to the lamp, causing the lamp to turn on and off about once every second.

Figure 4:
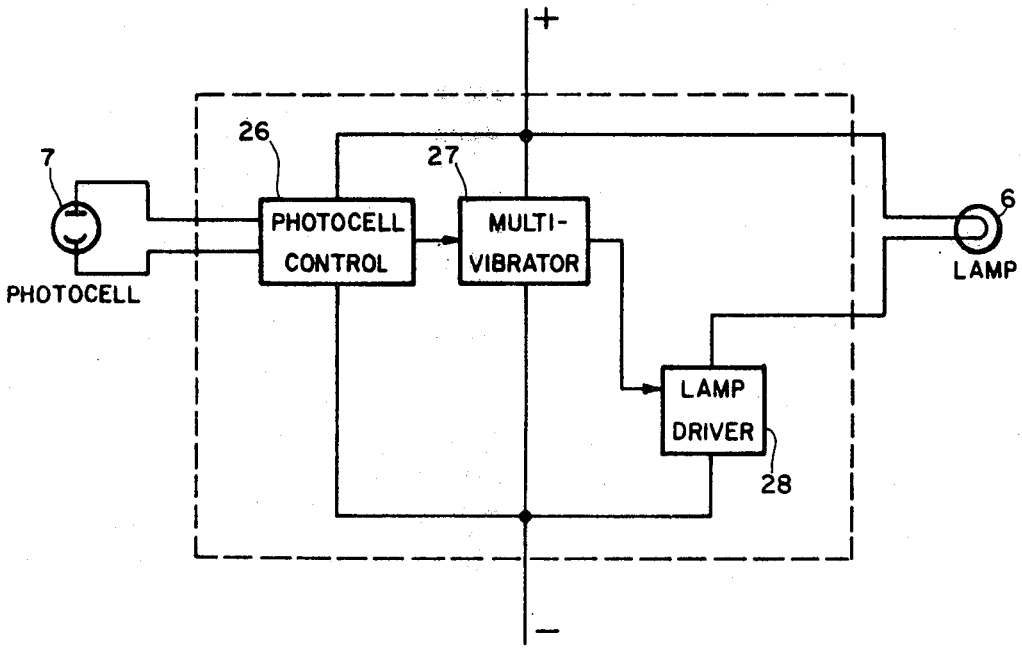
FIG. 4 is a more detailed circuit diagram used in the invention.

A preferred embodiment of the invention includes the use of a solar switch, such as solar switch No. 534-S manufactured by The Signal Division of Lear Siegler, Inc., of Los Angeles, California. The switch, shown on FIG. 2 as number 8, consists of a plurality of epoxy encased components, a block diagram of which is shown in FIG. 4. The portion of the circuitry encased in epoxy is indicated by the dashed line in FIG. 4. The photocell, which is a conventional cadmium sulfide cell, is connected to the photocell control 26, which is essentially a transistor which functions as a variable resistor. When the photocell is subjected to strong lighting, such as normal daylight, the resistance in the photocell control is reduced to a neglible quantity and the other transistors within the block are gated off. In effect, the photocell control turns the multivibrator 27 off during daylight hours and permits the multivibrator to operate when the cell is dark.

The multivibrator is a two transistor circuit which gates on 10% of the time and off 90% of the time, providing a frequency of about 55-60 cycles per minute. The lamp driver 28 is simply a transistor which is controlled by the multivibrator. The designations "+" and "−" on FIG. 4 indicate the power supply source. All of the circuitry in the photocell and flashing circuits is entirely conventional, and no invention is alleged to reside therein.

The wiring is also conventional and is effected by soldering or the like. Wires 30, 31, and 32 connect the battery and plunger switch to the solar switch; the electrical connection between wire 31 and bias terminal 18 is through metal disc 12.

The more important feature of the invention is the plunger switch which activates the unit when it is placed in a vertical position. While a simple plunger switch of the type shown is preferred, an other mechanism which engages the circuitry upon placing the marker in an upright position, and disengages the circuitry when the unit is placed on its side, is acceptable. For example, a mercury switch which completes the circuitry by gravitational flow of mercury when the unit is upright would be operable.

The use of the safety marker of the invention is very simple. The markers are stored on their sides when not in use, and transferred to a vehicle in the same position. The markers may be dispensed, for example to control traffic after a football game, from a moving truck. As the markers are set upright in place, the light will go on. If the optional photocell is used, the light will only go on when the ambient lighting has reached a predetermined low level. After the game is over and the traffic has disbursed, the lights will automatically go off as the markers are picked up.

Many alterations and variations to the device described herein will be well apparent to those skilled in the art and still come within the spirit and scope of the invention, which has been described in detail herein for purposes of illustration only. Accordingly, the invention should be considered limited only by the scope of the following claims.

I claim:

1. A road safety device comprises a ground-supported, weighted base, a hollow upright translucent marker member, electric light means for illuminating the marker member, battery means, switch means for automatically activating the light means when the marker is in an operating position and deactivating the light means when the marker is in a non-operating position, light-actuated switch means operatively electrically connected to the light means and the battery means such that said light-actuated switch means permits current to flow to the light means when ambient illumination is less than a predetermined level, and prohibits said current flow when the ambient illumination is greater than said predetermined level, the switch means comprising an actuating arm movable between an extended position protruding beyond the base and a depressed position, circuit closure means for electrically connecting the battery means to the light means when the actuating arm is in the depressed position and for disconnecting the battery means and light means when the actuating arm is in the extended position, biasing means for maintaining the actuating arm in a normally extended position, said actuating arm being positioned such that it is moved to the depressed position when the safety device is placed in operating position.

2. The road safety device of claim 1 wherein the device also comprises circuit interrupter means for flashing the light on and off.

* * * * *